US006773386B1

(12) United States Patent
Staniszewski

(10) Patent No.: US 6,773,386 B1
(45) Date of Patent: Aug. 10, 2004

(54) AUTOMATIC PAPER FOLDER

(75) Inventor: Tadeusz Staniszewski, Hackettstown, NJ (US)

(73) Assignee: Shap Inc., Hackettstown, NJ (US)

( * ) Notice: Subject to any disclaimer, the term of this patent is extended or adjusted under 35 U.S.C. 154(b) by 0 days.

(21) Appl. No.: 10/438,223

(22) Filed: May 14, 2003

(51) Int. Cl.[7] ..... B31F 1/00
(52) U.S. Cl. ..... 493/416; 493/419
(58) Field of Search ..... 493/416, 417, 493/405, 419, 420, 421, 436, 442, 460, 461, 462

(56) References Cited

U.S. PATENT DOCUMENTS 4,484,905 A * 11/1984 Ashburner ..... 493/415
4,573,672 A * 3/1986 Lehmann et al. ..... 270/45
4,619,101 A * 10/1986 Havey et al. ..... 53/117
4,816,108 A * 3/1989 Beck et al. ..... 156/356
4,834,699 A * 5/1989 Martin ..... 493/421
4,842,574 A * 6/1989 Noble et al. ..... 493/421
4,850,945 A * 7/1989 Whittenberger ..... 493/14
4,917,662 A * 4/1990 Gombault ..... 493/416
5,147,275 A 9/1992 Staniszewski
5,816,997 A * 10/1998 Crowley ..... 493/416
6,099,452 A * 8/2000 Hoza et al. ..... 493/416

* cited by examiner

*Primary Examiner*—Eugene Kim
(74) *Attorney, Agent, or Firm*—Richard M. Goldberg

(57) ABSTRACT

A paper folder including an input drive roller arrangement having an input drive roller with a circumferential gap, and an idler roller forming an input nip with the input drive roller for advancing a paper sheet into a housing; a flexible stripper pad of high friction material positioned at the circumferential gap; a fixed guide which guides the sheet into a loop turning back upon itself such that a leading edge of the sheet impinges upon a transverse line in a trailing portion of the sheet; an output roller arrangement in the housing which forms a folding nip extending along and adjacent to the transverse line; a second drive arrangement in the housing in front of the transverse line for positively driving the leading edge to impinge upon the transverse line; and a stocker mounted on the housing for stocking a plurality of fully folded paper-like sheets.

19 Claims, 10 Drawing Sheets

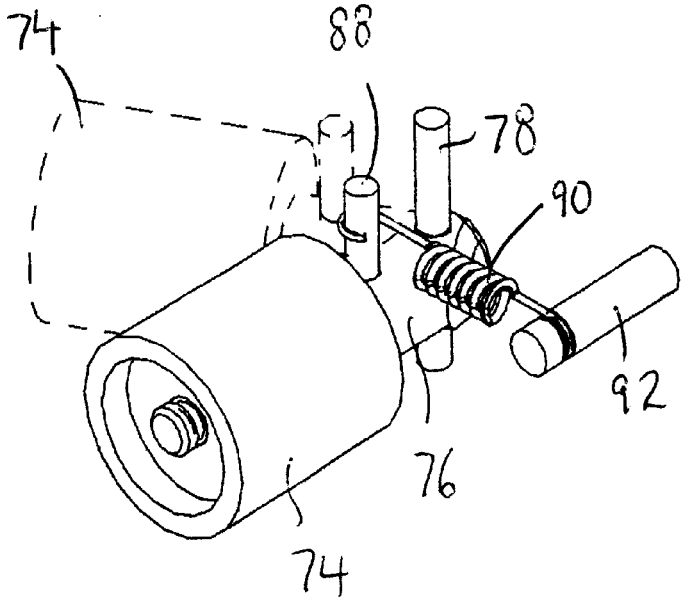
FIG. 4
FIG. 5
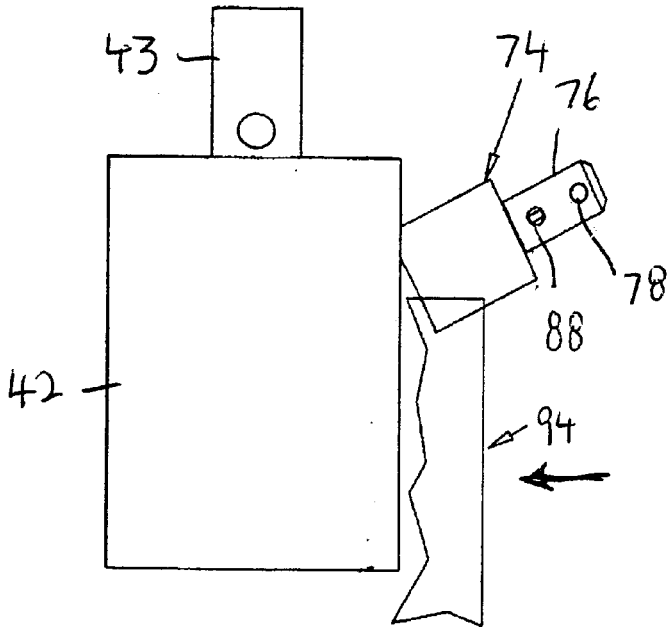

AUTOMATIC PAPER FOLDER

BACKGROUND OF THE INVENTION

The present invention relates to apparatus for automatically folding paper-like sheets of material, and more particularly, to an apparatus for folding one or more paper sheets into three sections in preparation for mailing in an envelope.

There are many instances in which sheets of paper are to be folded for insertion into envelopes for subsequent mailing. Specifically, it is often desirable to fold one or several letter size sheets into three equal sections for insertion into a standard mailing envelope. It is often important from the viewpoint of efficiency, time saving and minimizing of costs to effect such folding as rapidly and easily as possible.

A variety of machines are known which can accomplish such folding automatically when fed sequentially with individual sheets or sets of sheets of paper. However, such machines tend to be rather complex and expensive, and hence are not best suited for ordinary light office use.

U.S. Pat. No. 5,147,275 to the same inventor herein, and the entire disclosure of which is incorporated herein by reference discloses an automatic paper feeder that overcomes the aforementioned disadvantages. In this patent, the paper is guided into a loop so that the leading edge of the sheet strikes the trailing portion of the paper to create a fold thereat. Then, the leading edge and the folded trailing portion enter a nip between two rollers upon continued feeding of the paper, in order to fold the paper into three sections. However, the force of the leading edge of the sheet against the trailing portion in order to create the fold thereat is the result merely by the feeding of the paper into the device, which may not be entirely satisfactory. In other words, there is no positive forcing of the leading edge into the trailing portion of the sheet, but rather, merely the indirect force due to the initial feed of the paper into the device.

In addition, the device of this patent relies on a paper guide that is spring loaded and which expands against spring pressure, due to the force of the loop of paper, in order to permit additional paper to enter the device, after the leading edge of the sheet strikes its own trailing portion, and then when the leading edge and folded portion enter the nip, the spring pressure exerts a force on the guide to further aid in forcing the sheet further into the nip between the rollers. Again, this is an inexact manner of forcing the paper into the nip. The use of a spring loaded guide also increases the complexity of the device.

Still further, the last part of the paper to enter the nip is the loop of paper that had been guided by the paper guide. As this last loop of paper enters the nip, a second fold is formed. However, as the loop reduces in size and disengages from the paper guide, there is nothing to guide the paper. As a result, problems in the folding of this last loop can occur.

Still further, with the device of this patent, there are often problems with feeding of the paper at the entry port. Specifically, when loading a stack of papers, a plurality of papers will often be carried into the device at the same time, rather than separating the papers to supply them one at a time.

Lastly, there is no structure at the output for guiding and/or holding the folded sheets of paper.

SUMMARY OF THE INVENTION

Accordingly, it is an object of the present invention to provide a new and useful apparatus for folding sheets of paper-like materials that overcomes the aforementioned disadvantages.

It is another object of the present invention to provide a new and useful apparatus for folding sheets of paper-like materials in which there is an arrangement for providing a positive force of the leading edge into the trailing portion of the sheet.

It is still another object of the present invention to provide a new and useful apparatus for folding sheets of paper-like materials in which the positive force is created by additional driving rollers associated with the leading edge and which are driven by the input drive rollers.

It is yet another object of the present invention to provide a new and useful apparatus for folding sheets of paper-like materials in which the paper guide is fixed in place in order to simplify the construction.

It is a further object of the present invention to provide a new and useful apparatus for folding sheets of paper-like materials in which the same driving rollers associated with the leading edge also function to guide the reduced loop to form the second fold.

It is still a further object of the present invention to provide a new and useful apparatus for folding sheets of paper-like materials which effectively separates the papers at the entry port to supply them one at a time.

It is yet a further object of the present invention to provide a new and useful apparatus for folding sheets of paper-like materials which includes a paper stocker at the output for guiding and holding the folded papers.

It is another object of the present invention to provide a new and useful apparatus for folding sheets of paper-like materials which is relatively simple, inexpensive and easy to use.

In accordance with an aspect of the present invention, a paper folder for folding a paper-like sheet, includes a housing having an inlet opening for receiving a paper-like sheet and an outlet opening for permitting egress of a fully folded paper-like sheet; an input drive arrangement in the housing which advances a paper-like sheet from said inlet opening into said housing; a fixed guide in the housing which guides said advancing sheet into a loop that turns back upon itself such that a leading edge of said sheet impinges upon a transverse line in a trailing portion of said sheet; an output roller arrangement in the housing which forms a folding nip extending along and adjacent to said transverse line; and a second drive arrangement in the housing in front of said transverse line for positively driving the leading edge of said sheet to impinge upon said transverse line, such that the second drive arrangement continually advances said leading edge against said transverse line in said trailing portion of said sheet to force both said leading edge of said sheet and said transverse line in said sheet into said folding nip in order to form a first creased fold in said sheet extending along said transverse line and containing said sheet leading edge, said second drive arrangement being separate and apart from said fixed guide; whereby, upon further operation, said leading edge of said sheet remains within and travels with said fold as said fold passes through said folding nip, and a remaining portion of said sheet extending in a loop thereafter passes through said folding nip to form a second creased fold, thereby folding said sheet into a fully folded paper-like sheet having three sections and supplying said fully folded paper-like sheet to said outlet opening in said housing.

The second drive arrangement includes a pair of rollers having a nip therebetween for engaging the leading edge and driving the leading edge to impinge upon the transverse line. The pair of rollers includes an idler roller and at least one pinch roller, with each pinch roller being mounted on a shaft which is pivotally movable between a first position in which the pinch roller is in pressure contact with the idler roller to advance the leading edge, and to a second position in which the pinch roller is moved out of the path of the loop in order to permit the loop to enter the output roller arrangement. Preferably, there are two the pinch rollers at opposite sides of the housing for engaging opposite sides of the leading edge. The second drive arrangement further includes a spring associated with each pinch roller for biasing each pinch roller toward the first position, and wherein each pinch roller is moved to the second position by a force exerted by the loop as the loop moves toward the output roller arrangement, against the force of the respective spring. In addition, the second drive arrangement is driven by the input drive arrangement.

The guide is fixed in position and is formed by inner walls of the housing. Specifically, the housing includes a base having a rear wall, side walls, a bottom wall with an inverted V-shaped projection and curved front wall, and a cover having a curved front wall which forms a continuation of the curved front wall of the base; and the guide is formed by the V-shaped projection, the curved front wall of the base and the curved front wall of the cover.

The input drive arrangement includes an input drive roller and an idler roller forming an input nip therebetween; and the output roller arrangement includes an output roller forming the folding nip with the input drive roller.

A mechanical sensor is provided for sensing when the sheet is in the folder. In this regard, a drive motor operates the input drive arrangement, and a switch is operated by the mechanical sensor to turn the motor on when a sheet enters the folder and to turn the motor off when the sheet has exited the folder.

In accordance with another aspect of the present invention, a paper folder for folding a paper-like sheet, includes a housing having an inlet opening for receiving a paper-like sheet and an outlet opening for permitting egress of a fully folded paper-like sheet; an input drive arrangement in the housing which advances a paper-like sheet from the inlet opening into the housing; a guide in the housing which guides the advancing sheet into a loop that turns back upon itself such that a leading edge of the sheet impinges upon a transverse line in a trailing portion of the sheet; an output roller arrangement in the housing which forms a folding nip extending along and adjacent to the transverse line, such that as the leading edge continually advances against the transverse line in the trailing portion of the sheet, the leading edge and the transverse line are forced into the folding nip in order to form a first creased fold in the sheet extending along the transverse line and containing the sheet leading edge and upon further operation, a remaining portion of the sheet extending in a loop passes through the folding nip to form a second creased fold, thereby folding the sheet into a fully folded paper-like sheet having three sections and supplying the fully folded paper-like sheet to the outlet opening in the housing; and a stocker mounted on an outside wall of the housing adjacent to the outlet opening for stocking a plurality of the fully folded paper-like sheets.

The stocker includes a bent rod having a first section that extends into the housing; and a downwardly angled section connected with the first section and which is spaced slightly from the housing; and a spring within the housing for biasing the first section such that the downwardly angled section is pivoted towards the housing and the fully folded sheets are held by the downwardly angled section with a spring force.

In accordance with still another aspect of the present invention, a paper folder for folding a paper-like sheet, including a housing having an inlet opening for receiving a paper-like sheet and an outlet opening for permitting egress of a fully folded paper-like sheet; an input paper tray for providing a stack of the paper-like sheets such that lower edges thereof are positioned adjacent the inlet opening; an input drive arrangement in the housing which advances a paper-like sheet from the inlet opening into the housing, the input drive arrangement including an input drive roller arrangement having a circumferential gap, and an idler roller forming an input nip with the input drive roller arrangement; a flexible stripper pad of high friction material positioned at the circumferential gap; a guide in the housing which guides the advancing sheet into a loop that turns back upon itself such that a leading edge of the sheet impinges upon a transverse line in a trailing portion of the sheet; an output roller arrangement in the housing which forms a folding nip extending along and adjacent to the transverse line, such that as the leading edge continually advances against the transverse line in the trailing portion of the sheet, the leading edge and the transverse line are forced into the folding nip in order to form a first creased fold in the sheet extending along the transverse line and containing the sheet leading edge and upon further operation, a remaining portion of the sheet extending in a loop passes through the folding nip to form a second creased fold, thereby folding the sheet into a fully folded paper-like sheet having three sections and supplying the fully folded paper-like sheet to the outlet opening in the housing.

In one embodiment, the input drive roller arrangement includes a single input drive roller having a circumferential groove which forms the circumferential gap. In another embodiment, the input drive roller arrangement includes two coaxial, spaced apart drive rollers having the circumferential gap therebetween.

In addition, a fixed beam is positioned in front of a lower portion of the paper tray, with the flexible stripper pad being secured to the fixed beam at a position of the circumferential gap. An adjusting screw extends through the fixed beam to adjust a position of the stripper pad relative to the input drive arrangement in order to adjust a gap between the input drive arrangement and the stripper pad.

There is also a spring gate secured to the fixed beam between the stripper pad and the fixed beam.

The above and other objects, features and advantages of the invention will become readily apparent from the following detailed description thereof which is to be read in connection with the accompanying drawings.

BRIEF DESCRIPTION OF DRAWINGS

FIG. 4 is an enlarged perspective view of the spring loaded pinch roller assembly;

FIG. 5 is a side elevational view of the spring loaded pinch roller assembly;

DETAILED DESCRIPTION

Figure 1:
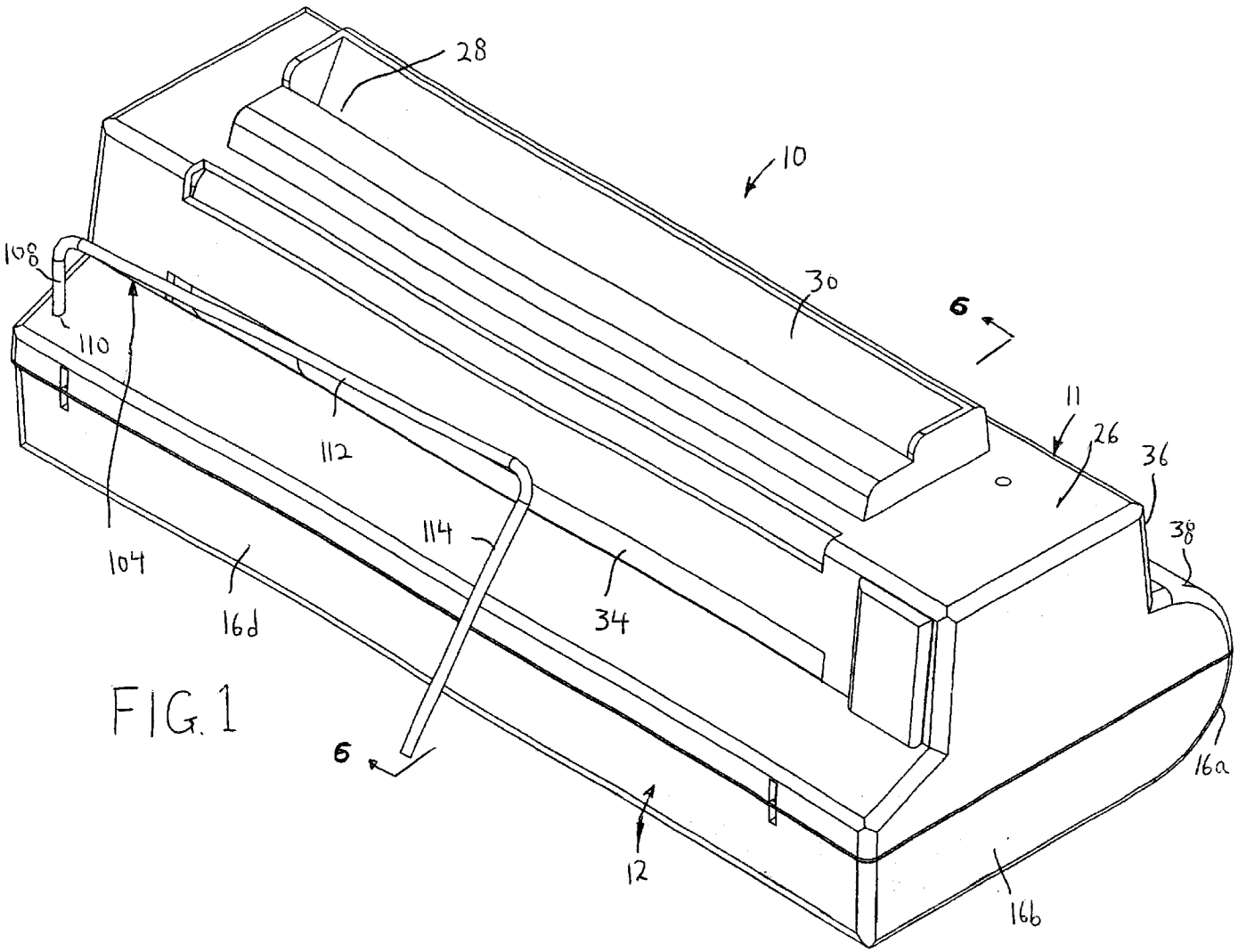
FIG. 1 is a rear perspective view of an automatic paper folder according to a first embodiment of the present invention.

Referring to the drawings in detail, an automatic paper folder 10 according to the present invention includes a housing 11 defined by a base 12 and a cover 26.

Base 12 has a generally rectangular bottom wall 14 and four upstanding walls 16*a*–16*d* which define an upper open end 18. Front wall 16a slopes up gently for forming the paper guide, the purpose for which will be understood from the discussion hereafter. Bottom wall 14 also includes an inverted V-shaped projection 20 extending substantially the entire length of base 12 and defined by angled walls 20*a* and 20*b*. As will be understood from the discussion hereafter, angled wall 20*a* also forms part of the paper guide. Front and rear walls 16*a* and 16*c* include slots 22 at each end for receiving vertical assembly support walls 24.

Cover 26 is mounted on base 12 and assembly support walls 24. Cover 26 includes an upper inlet opening 28 extending lengthwise thereof and surrounding by angled walls 30 and 32 that lead the paper into inlet opening 28. Cover 26 also includes an outlet opening 34 extending lengthwise thereof at a rear wall thereof. As shown best in FIGS. 5–7, the front wall 36 of cover 26 includes a curved portion 38 along the length thereof which forms a continuation of the curvature with front upstanding wall 16*a* so that, together, they form an effectively half-cylindrical shape. Angled wall 20*a*, front upstanding wall 16*a* and curved portion 38 together form a fixed paper guide 40 for guiding the leading edge of a sheet of paper around and back on itself until the leading edge contacts its trailing portion, as will be discussed in more detail hereafter.

An input drive roller 42 is provided in housing 11 immediately below upper inlet opening 28 and is mounted on a shaft 43 which is supported at opposite ends by assembly support walls 24. Input idler rollers 44, of a lesser diameter than input drive roller 42, are mounted on a common shaft 46 and extend parallel to input drive roller 42. Shaft 46 is supported at opposite ends by assembly support walls 24 so that input idler rollers 44 are adjacent to and in pressure contact with input drive roller 42 so as to form an input nip 48 therebetween. Input idler rollers 44 are driven by gearing with input drive roller 42, as will be understood from the discussion hereafter.

An output drive roller 50 is provided in housing 11 immediately below input drive roller 42 and is mounted on a shaft 52 which is supported at opposite ends by assembly support walls 24. Output drive roller 50 is in pressure contact with input drive roller 42 so as to form an output nip 54 therebetween. Input drive roller 42 is driven by gearing from output drive roller 50, as will be understood from the discussion hereafter.

Figure 3:
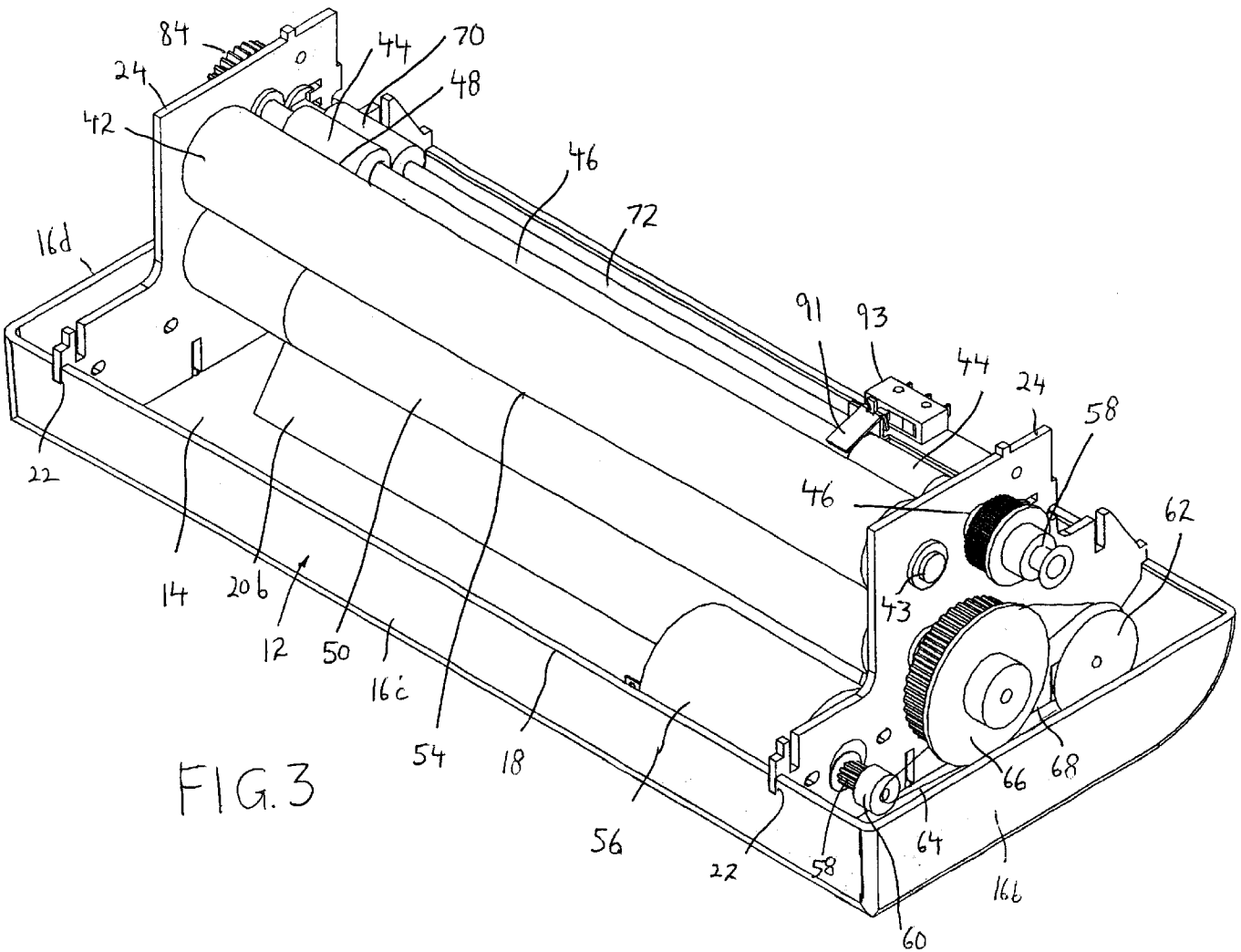
FIG. 3 is a rear perspective view of the automatic paper folder, with the cover removed.

In this regard, as shown best in FIG. 3, a drive motor 56 is provided on base 12 at the rear of housing 11. Drive motor 56 can be connected to an electrical line cord (not shown) for connection to an electrical outlet, for example, of 110 volts AC, by way of a 12-volt DC converter, or may be powered by a battery (not shown). Preferably, drive motor 56 is a standard 12-volt DC motor.

Figure 2:
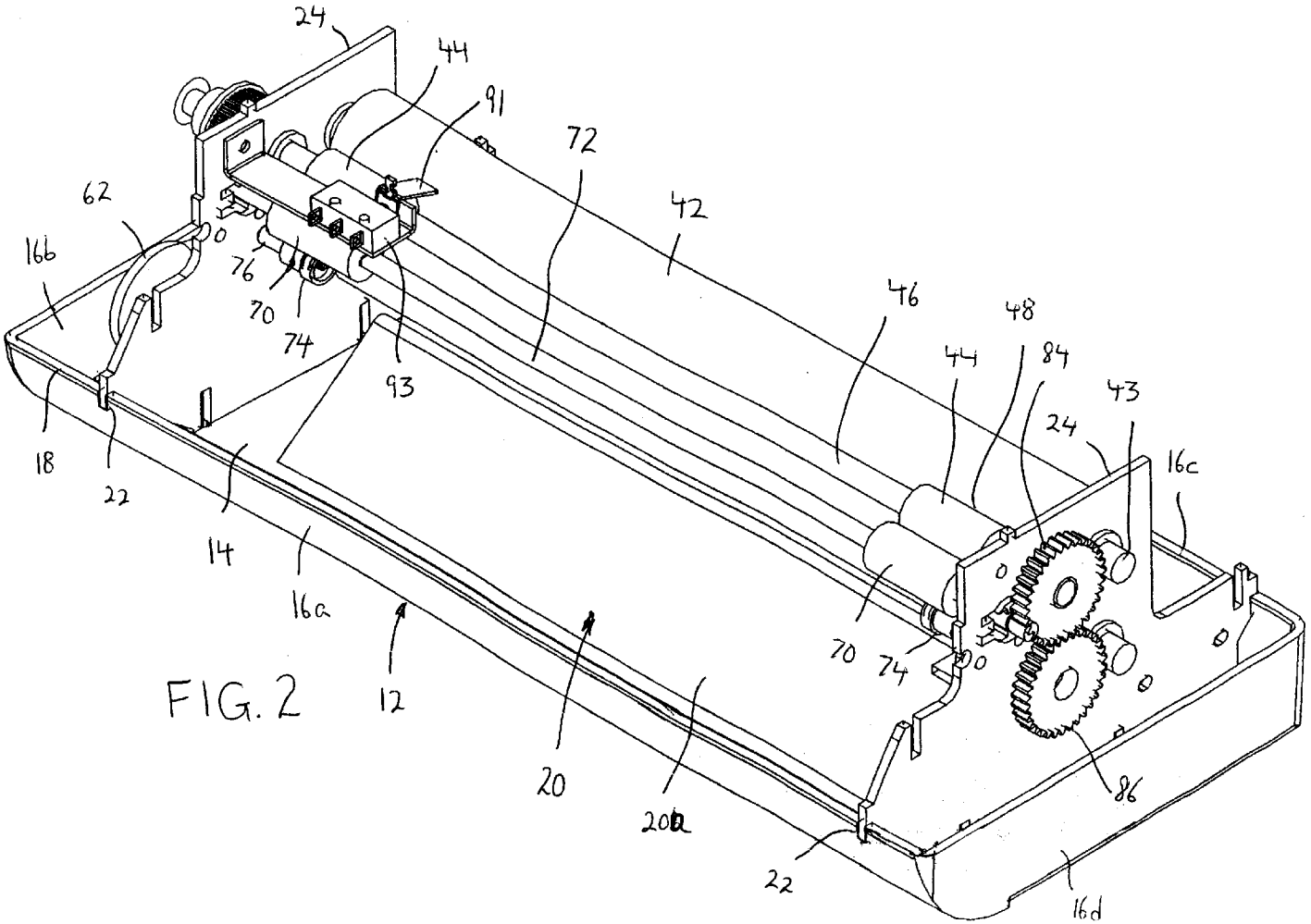
FIG. 2 is a front perspective view of the automatic paper folder, with the cover removed.

Drive motor 56 has an output shaft 58 that extends through one assembly support wall 24 and has a drive gear 60 at an end thereof. An intermediate pulley assembly 62 is mounted to the outside of the same assembly support wall 24, but at the front of the housing 11. Intermediate pulley assembly 62 includes two coaxially mounted, axially spaced apart gears 62*a* and 62*b* mounted on shaft 53 that extends to the outside of the one assembly support wall 24. An endless belt 64 is wrapped about pulley 60 and pulley 62*a* of pulley assembly 62, such that drive motor 56 effectively drives pulley assembly 62. A pulley 66 is mounted to the end of shaft 52 that extends out through the same assembly support wall 24, and an endless belt 68 extends between pulley 62*b* of pulley assembly 62 and pulley 66, whereby drive motor 56 serves to rotate shaft 52, and thereby output drive roller 50. As shown in FIG. 2, the end of shaft 52 that extends out from the opposite assembly support wall 24 includes a gear 86 therein, and the end of shaft 43 that extends out from the same opposite assembly support wall 24 includes a gear 84 therein which is in meshing engagement with gear 86. Accordingly, rotation of shaft 52 causes rotation of output drive roller 50, and also causes rotation of input drive roller 42 through gears 84 and 86. In addition, a gear 45 is provided on the shaft 46 that extends out from the same opposite assembly support wall 24, with gear 45 being in meshing engagement with gear 84 so as to be driven thereby.

Second idler rollers 70 are mounted on a shaft 72 which is supported at opposite ends by assembly support walls 24, such that second idler rollers 70 are in parallel, slightly spaced apart relation from input idler rollers 44: Second idler rollers 70 are on the opposite side of input idler rollers 44 from input drive roller 42 and positioned slightly below input idler rollers 44. A gear 71 is provided on the shaft 72 that extends out from the same opposite assembly support wall 24, with gear 71 being in meshing engagement with gear 45 so as to be driven thereby. Spring loaded pinch rollers 74 are mounted on stub shafts 76 which are pivotally mounted to axles 78 that are fixed to opposite assembly support walls 24. Spring loaded pinch rollers 74 are thereby positioned immediately below second idler rollers 70 such that pinch rollers 74 are in frictional engagement with second idler rollers 70 such that, as second idler rollers 70 are rotated in the direction of arrow 80 in FIGS. 5–7, pinch rollers 74 are caused to rotate by frictional engagement. As a result, a nip 82 is formed between second idler rollers 70 and pinch rollers 74.

In addition, as shown in FIG. 4, each stub shaft 76 has a pin 88 thereon which is parallel to axles 78. A coil spring 90 has one end wrapped about each respective pin 88 and the opposite end thereof secured to a fixed bar 92 that can be fixed in any manner to a support wall 24. In the unbiased position of each pinch roller 74, shown by the solid line in FIG. 4, pinch roller 74 is positioned in frictional engagement with second idler roller 70. However, as will be explained in more detail hereafter, as the loop of paper passes by, the loop biases the pinch roller 74 to the dashed line position in FIG.

3 against the force of coil springs 90 in order to permit the loop to pass into the output nip 54. As the paper loop passes pinch roller 74, coil springs 90 bring pinch rollers 74 back to the solid line neutral position shown in FIG. 4.

Each of the above rollers 42, 44, 50, 70 and 74 preferably comprises a central steel shaft covered with a layer of elastomeric material.

As a result of the above construction, when a sheet of paper 94 enters upper inlet opening 28, the leading edge 96 thereof is sensed by a spring biased actuator arm 91 of a microswitch 93 immediately above input nip 48, which in turn, sends a signal to actuate drive motor 56. Actuator arm 91 is preferably a bent plate which is pivoted to microswitch 93 which senses the rotational position of the bent plate, and opens and closes the power circuit for drive motor 56 to turn it on when paper is in the folder and to turn it off at other times. Thus, when the leading edge 96 is inserted within input nip 48 between input drive roller 42 and input idler rollers 44, the incoming sheet deflects actuator arm 91 against the spring force, thereby to operate microswitch 93 so as to turn on drive motor 56. Alternatively, an optical detector can be used in place of actuator arm 91.

Figure 6:
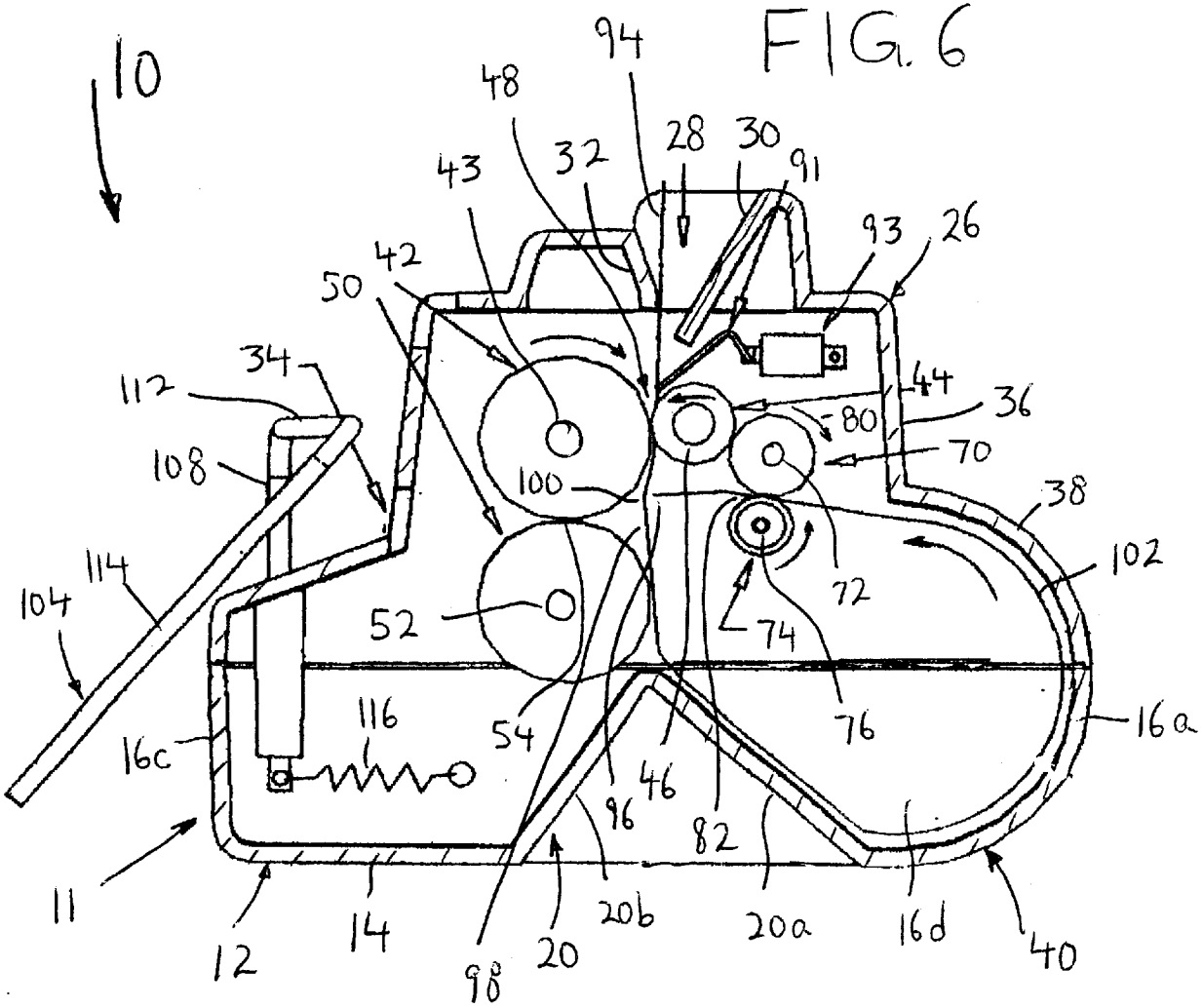
FIG. 6 is a vertical cross-sectional view taken along line 6—6 of FIG. 1, showing the leading edge just prior to engaging the trailing portion of the sheet of paper.
Figure 7:
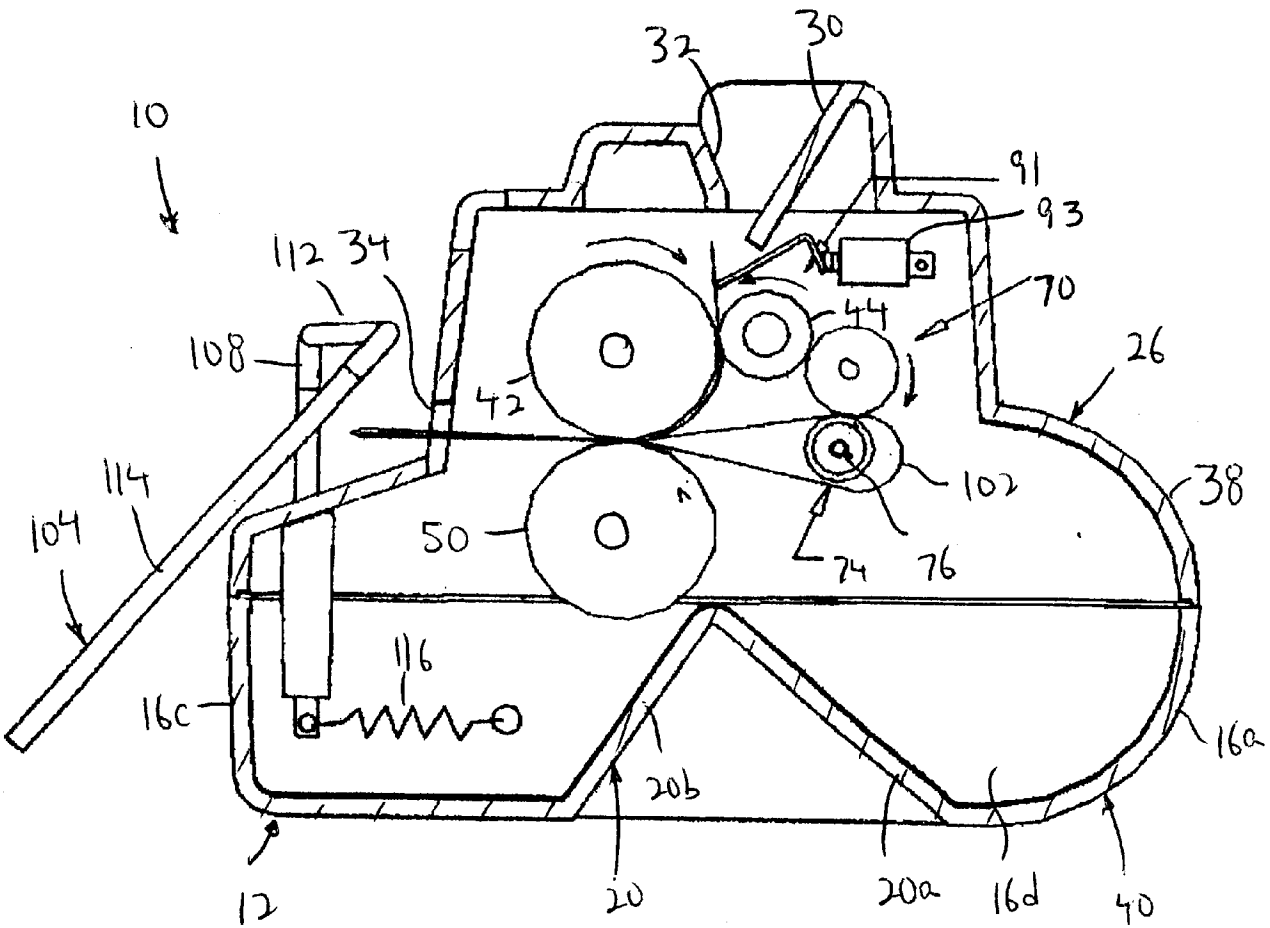
FIG. 7 is a vertical cross-sectional view similar to FIG. 6, showing the first fold line formed and the paper extending partially through the nip.
Figure 8:
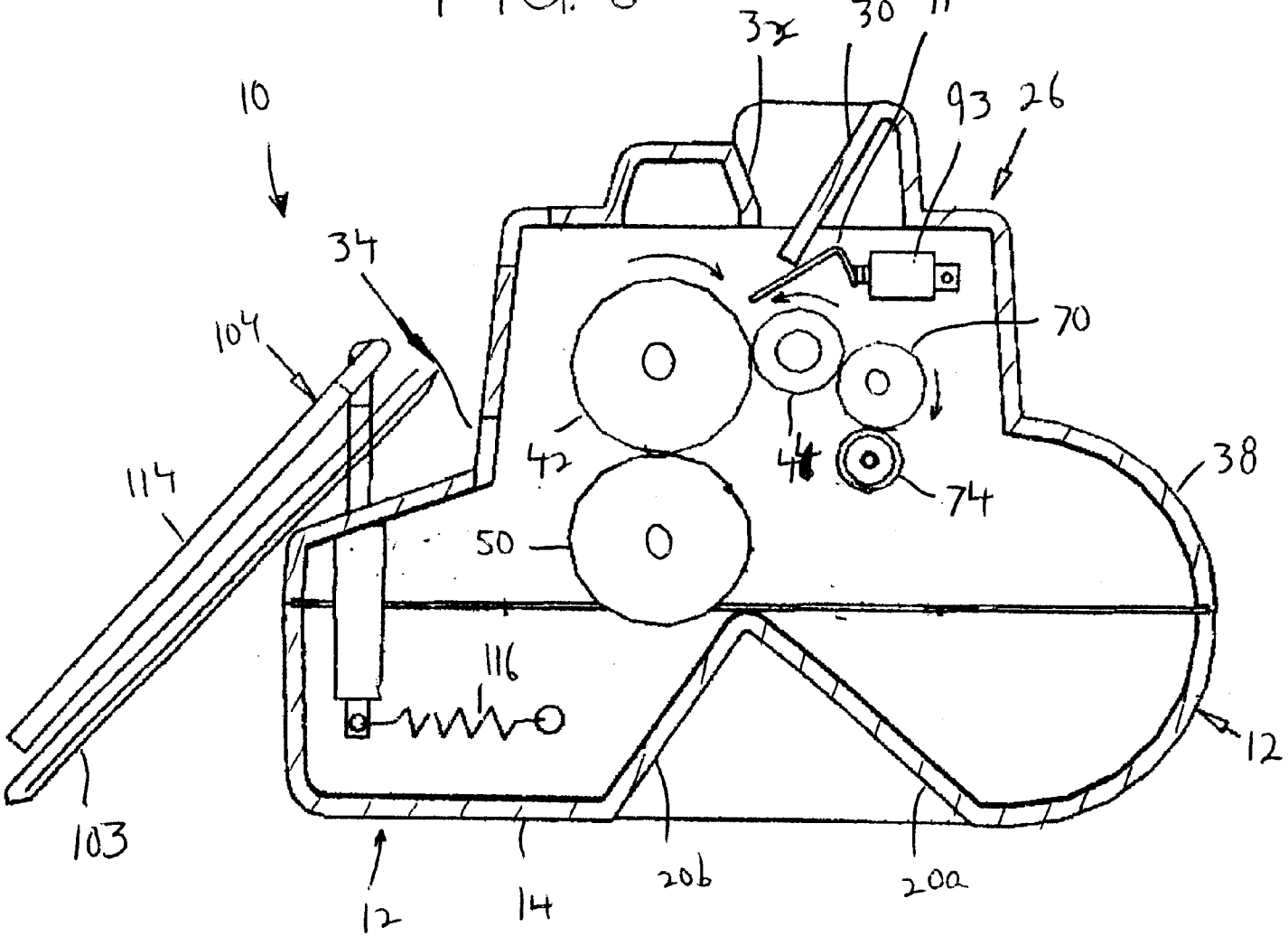
FIG. 8 is a vertical cross-sectional view similar to FIG. 6, showing the paper fully folded and held down by the stocker.

Because input drive roller 42 is driven in the manner described above, the paper 94, which is manually introduced downwardly through upper inlet opening 28, is urged forwardly into housing 11 as input drive roller 42 is rotated clockwise in FIGS. 5–7, as shown by the arrows therein. As paper 94 is moved forward, leading edge 96 is moved toward paper guide 40, where it is first guided by angled wall 20*a* and then by curved front upstanding wall 16a and curved portion 38. The inner surfaces of these walls are smooth so that the sheet of paper 94 will slide over them easily. Leading edge 96 then curves around on itself and is then guided between second idler roller 70 and pinch rollers 74. Because of the positive drive of pinch rollers 74, the leading edge 96 is advanced until leading edge 96 contacts its trailing portion 98 along a contact line 100 in the sheet of paper 94. Transverse contact line 100 is preferably located about two-thirds of the way from leading edge 96 to the trailing edge of the sheet. Upon continued advancement of the sheet of paper 94, leading edge 96 produces a linear dimple in the trailing portion 98 of the sheet, along contact line 100, and with further continued advancement of the sheet of paper, the contact line 100 along with the leading edge 96 of the sheet bearing against it, is drawn into and through nip output 54 to form a first creased fold line at contact line 100. During this part of the fold operation, the loop 102 of paper which had been guided by angled wall 20*a*, curved front upstanding wall 16*a* and curved portion 38, reduces in size and thereby moves inwardly away from these surfaces. This latter loop 102 is then advanced through output nip 54, so as to be flattened against the remaining trailing portion 98 of the sheet as the sheet exits from nip 54, thereby completing the folding of the sheet into three sections.

However, during this folding operation, as shown best in FIG. 7, the reduced size loop 102 engages pinch roller 74. Upon continued advancement of reduced size loop 102 toward output nip 54, pinch rollers 74 are biased in the direction of the loop movement to the dashed line position in FIG. 4, overcoming the force of coil springs 90 in order to permit the loop 102 to pass into the output nip 54. As the paper loop 102 passes pinch rollers 74, coil springs 90 bring pinch rollers 74 back to the solid line neutral position shown in FIG. 4, ready for the next sheet of paper to be folded.

It will therefore be appreciated that pinch rollers 74 and second idler roller 70 together form an arrangement for positively advancing the leading edge 96 against contact line 100 to ensure that the trailing portion 98 is properly folded. At the same time, the pivoting nature of pinch rollers 74 permit the loop of paper 102 to pass thereby and enter the output nip 54.

After the sheet of paper 94 has passed into housing 11, microswitch 93 remains activated by the trailing portion 98 of the sheet until after the contact line 100 of the sheet has passed through the output nip 54 and is about to exit from housing 11. Generally, after the trailing edge of the sheet has passed actuator arm 91 so that the latter is biased to its original position, there is a few seconds time delay before drive motor 56 is turned off, in order to permit the input drive roller 42 and output drive roller 50 to pass the fully folded sheet out through outlet opening 34.

As the fully folded sheet of paper 103 is pushed out from output nip 54, it exits through outlet opening 34 in cover 26. In order to hold the folded papers in some order, there is a spring loaded stocker 104 secured to cover 26 adjacent outlet opening 34. Specifically, stocker 104 includes a bent metal or plastic rod that includes a vertical securing section 108 that fits in a hole 110 in the rear of cover 26, a horizontal section 112 that extends lengthwise along housing 11 from the upper end of vertical securing section 108 to an approximate midpoint of housing 11, and a downwardly angled section 114 that extends downwardly at an angle from the free end of horizontal section 112 and which is spaced slightly from cover 26. A coil spring 116 within housing 11, has one end 116a secured to one side of the upstanding side wall of cover 26, and an opposite end 116b secured to the lower end of vertical securing section 108 that extends into housing 11. As a result, stocker 104 is spring loaded. In this manner, as the fully folded sheet of paper 103 exits output opening 32, it is deflected down, guided and held by the spring loaded stocker 104. Each succeeding fully folded sheet of paper 103 that exits output opening 32 is stacked on the previous fully folded sheets of paper 103 and held by downwardly angled section 114 of stocker 104 with a spring force.

Thus, a plurality of fully folded sheets of paper 103 are folded into three equal sections suitable for insertion into a standard envelope for letters.

Figure 9:
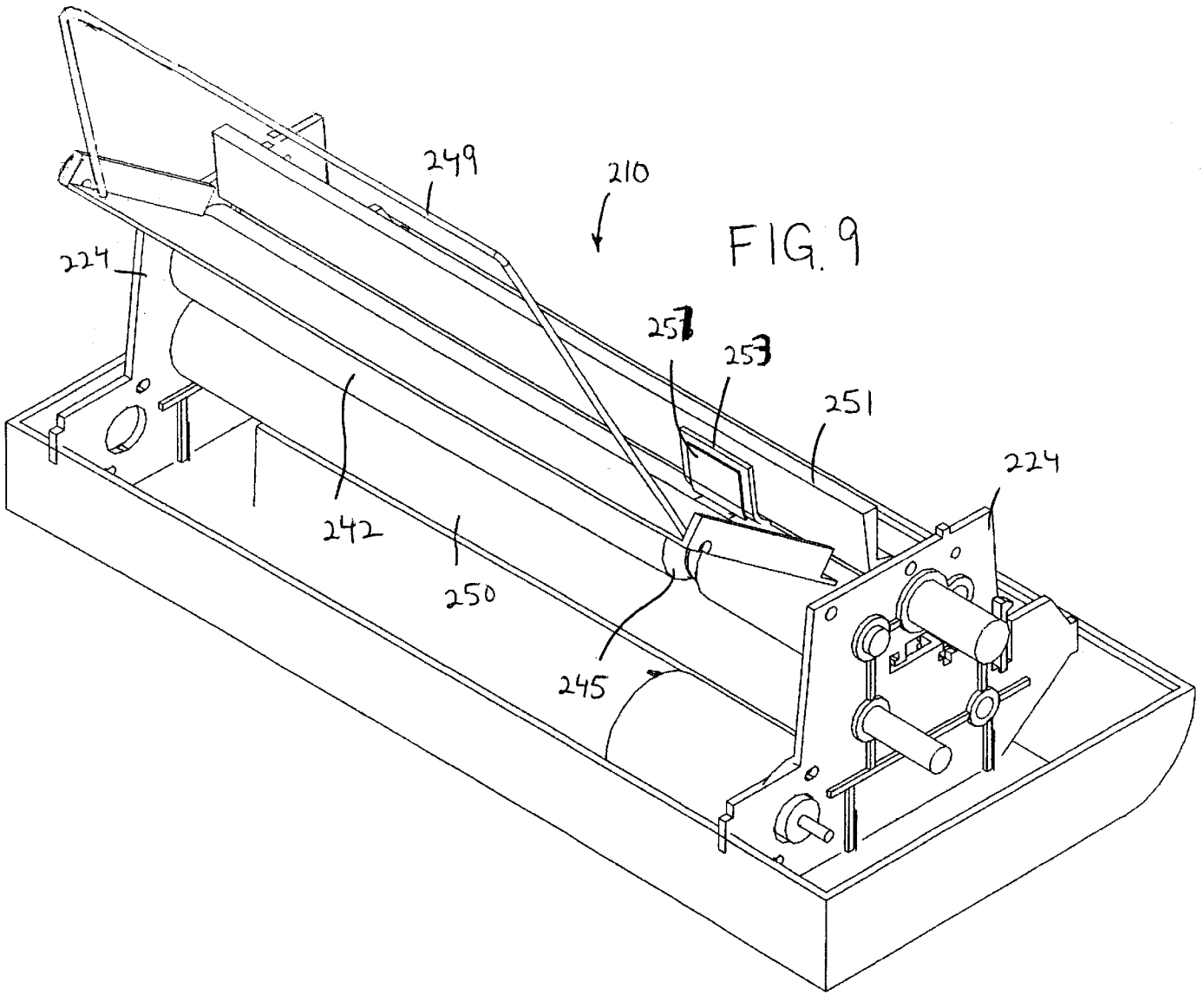
FIG. 9 is a perspective view of an automatic paper folder according to a second embodiment of the present invention.
Figure 10:
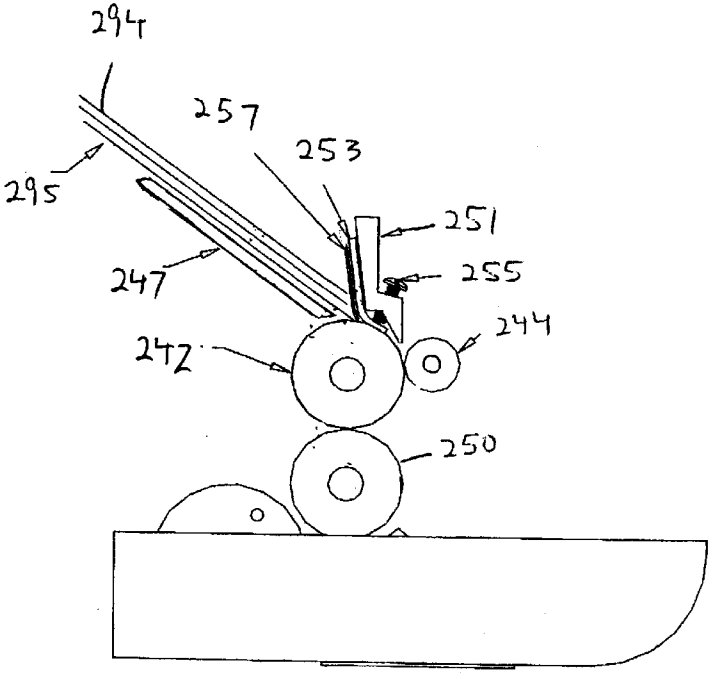
FIG. 10 is a side elevational view of the input arrangement for separating individual sheets of paper in the second embodiment.
Figure 11:
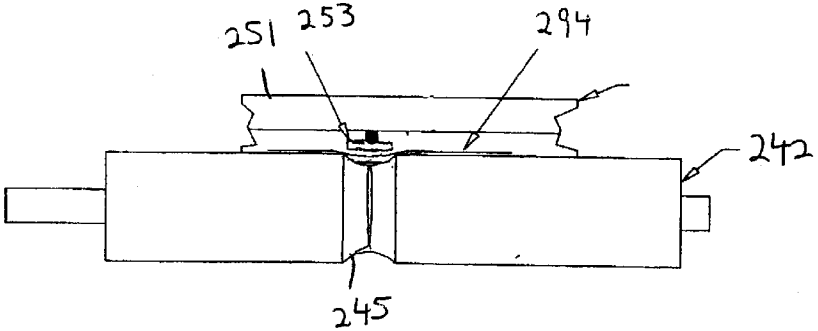
FIG. 11 is a front elevational view of the input arrangement for separating individual sheets of paper in the second embodiment, but omitting the paper tray.

Referring now to FIGS. 9–11, a modified automatic paper folder 210 will now be explained, in which elements common to those in FIGS. 1–8 are identified by the same numerals, but augmented by 200. The pinch rollers have been removed from this embodiment for the sake of brevity of the drawings.

Specifically, as discussed above, with the device of U.S. Pat. No. 5,147,275, there are often problems with feeding of the paper at the entry port. Specifically, when loading a stack of papers, a plurality of papers will often be carried into the device at the same time, rather than separating the papers to supply them one at a time. Automatic paper folder 210 according to the present invention has been constructed to overcome this problem.

As shown, input drive roller 242 includes a circumferential groove 245 at a mid-position thereof, with groove 245 having a concave sectional shape. Alternatively, two input drive rollers can be provided with a circumferential gap therebetween. Reference in the claims to a circumferential gap is intended to cover the situation where there are two input drive rollers with a gap therebetween and where there is one input drive roller with a circumferential groove therein.

Input drive roller 242 is still in contact with input idler roller 244 and output drive roller 250. A stack 295 of sheets of paper 294 are provided on a paper tray 247 mounted between assembly support walls 224 for guiding the paper to the input nip 248. A wire guide 249 can be provided at the upper end of paper tray 247 to further guide the stack of paper.

A fixed or stationary beam 251 extends substantially along the length of paper folder 210 between assembly support walls 224, and is fixed thereto, at a position in front of the lower portion of paper tray 247 and directly above input drive roller 242. A flexible stripper pad 253 of high friction material is secured to the rear face of stationary beam 251 at the position of circumferential groove 245, and preferably extending slightly into circumferential groove 245. An adjusting screw 255 which extends through stationary beam 251 can move stripper pad 253 toward input drive roller 242 to adjust the gap between input drive roller 242 and stripper pad 253. Because of the resiliency of stripper pad 253, when adjusting-screw 255 is unscrewed, stripper pad 253 will move upwardly by spring action with adjusting screw 255. There is further a gate 257 constructed from a metal spring, plexiglass or other suitable material that is secured to the rear face of stationary beam 251 on top of stripper pad 253, but not extending down as far as stripper pad 253, and which further serves to separate the papers.

When paper tray 247 is loaded with a stack of paper, the bottom edge of the lowermost paper sheet 294 is in contact with the outer surface of input drive roller 242. Other paper sheets 294 of the stack are in contact with gate 257. As a result, the paper sheets press on input drive roller 242 and gate 257 by means of gravity. When input drive roller 242 is activated to rotate, which can occur by a manual switch or automatically, the friction of input drive roller 242 moves one or more of the lowermost sheets of paper 294 forward. Even if gate 257 fails to separate the lowermost sheet from other sheets, high friction stripper pad 253 prevents all but the lowermost sheet of paper 294 from proceeding further. This is because flexible stripper pad 253 enters partially into circumferential groove 245, the extent being determined by adjusting screw 255. However, as input drive roller 242 continues to rotate, the friction between input drive roller 242 and the lowermost sheet of paper 294 increases due to the wedging action from stripper pad 253. Of course, the paper sheets 294 are bent slightly at the center, forming a concave dimple as they pass by stripper pad 253. Because the friction between the lowermost sheet of paper and the next sheet of paper is less than that between input drive roller 242 and the lowermost sheet of paper, only the lowermost sheet of paper 294 is permitted to pass into the housing. As the trailing edge of the lowermost sheet of paper exits stripper pad 253, the next lowest sheet of paper is forced by friction with input drive roller 242 to proceed further. Thus, there is no need for any electronic controller to monitor the rate of feeding since the rate is self-controlled.

Figure 12:
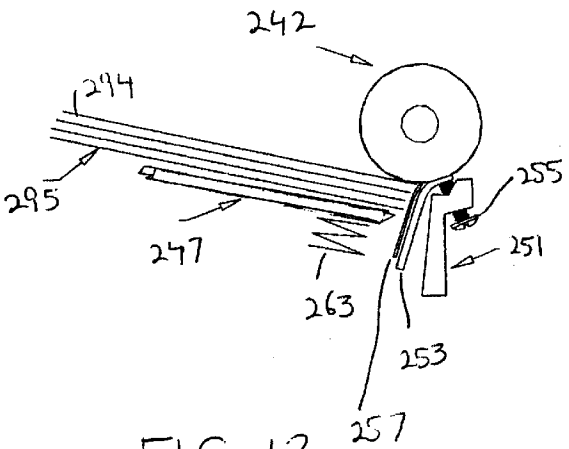
FIG. 12 is a side elevational view of a modified input arrangement for separating individual sheets of paper.
Figure 13:
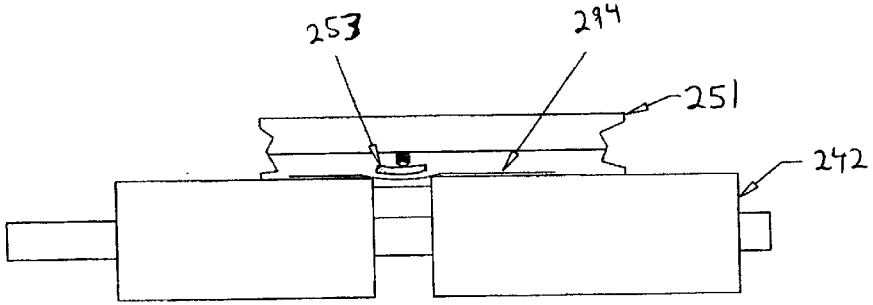
FIG. 13 is a front elevational view of the modified input arrangement.

A modified construction of the above input feeding arrangement is shown in FIGS. 12 and 13, with the gate omitted in FIG. 13. Specifically, paper tray 247 is mounted below input drive roller 242 and is forced up by a coil spring 263 to force the sheets of paper 294 against input drive roller 242. The stationary beam 251, flexible stripper pad 253 and adjusting screw 255 therefor, as well as gate 257, are also positioned below input-drive roller 242. The operation, however, would be the same as in the embodiment of FIGS. 9–11. Of course, the positioning of the various other rollers would have to be modified to take into account this arrangement.

Further, rather than providing a single input drive roller 242 with a circumferential groove, two input drive rollers 242*a* and 242*b* are provided, spaced apart from each other to form a circumferential gap or effective circumferential groove 245.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A paper folder for folding a paper-like sheet, comprising:

a housing having an inlet opening for receiving a paper-like sheet and an outlet opening for permitting egress of a fully folded paper-like sheet;

an input drive arrangement in the housing which advances a paper-like sheet from said inlet opening into said housing;

a fixed guide in the housing which guides said advancing sheet into a loop that turns back upon itself such that a leading edge of said sheet impinges upon a transverse line in a trailing portion of said sheet;

an output roller arrangement in the housing which forms a folding nip extending along and adjacent to said transverse line; and a second drive arrangement in the housing in front of said transverse line for positively driving the leading edge of said sheet to impinge upon said transverse line, such that the second drive arrangement continually advances said leading edge against said transverse line in said trailing portion of said sheet to force both said leading edge of said sheet and said transverse line in said sheet into said folding nip in order to form a first creased fold in said sheet extending along said transverse line and containing said sheet leading edge, said second drive arrangement being separate and apart from said fixed guide;

whereby, upon further operation, said leading edge of said sheet remains within and travels with said fold as said fold passes through said folding nip, and a remaining portion of said sheet extending in a loop thereafter passes through said folding nip to form a second creased fold, thereby folding said sheet into a fully folded paper-like sheet having three sections and supplying said fully folded paper-like sheet to said outlet opening in said housing.

2. The paper folder according to claim 1, wherein said second drive arrangement includes a pair of rollers having a nip therebetween for engaging the leading edge and driving the leading edge to impinge upon said transverse line.

3. The paper folder according to claim 2, wherein said pair of rollers include an idler roller and at least one pinch roller, with each said pinch roller being mounted on a shaft which is pivotally movable between a first position in which the pinch roller is in pressure contact with said idler roller to advance said leading edge, and to a second position in which the pinch roller is moved out of the path of said loop in order to permit said loop to enter said output roller arrangement.

4. The paper folder according to claim 3, wherein there are two said pinch rollers at opposite sides of said housing for engaging opposite sides of said leading edge.

5. The paper folder according to claim 3, wherein said second drive arrangement further includes a spring associated with each pinch roller for biasing each said pinch roller toward said first position, and wherein each said pinch roller is moved to said second position by a force exerted by said loop as said loop moves toward said output roller arrangement, against the force of the respective spring.

6. The paper folder according to claim 1, wherein said second drive arrangement is driven by said input drive arrangement.

7. The paper folder according to claim 1, wherein said guide is fixed in position and is formed by inner walls of said housing.

8. The paper folder according to claim 7, wherein:

said housing includes:

a base having a rear wall, side walls, a bottom wall with an inverted V-shaped projection and curved front wall, and a cover having a curved front wall which forms a continuation of said curved front wall of said base, and said guide is formed by said V-shaped projection, said curved front wall of said base and said curved front wall of said cover.

9. The paper folder according to claim 1, wherein:

said input drive arrangement includes an input drive roller and an idler roller forming an input nip therebetween; and said output roller arrangement includes an output roller forming said folding nip with said input drive roller.

10. The paper folder according to claim 1, further comprising:

a mechanical sensor for sensing when said sheet is in said folder, a drive motor for operating said input drive arrangement, and a switch operated by said mechanical sensor to turn said motor on when a sheet enters said folder and to turn said motor off when said sheet has exited said folder.

11. A paper folder for folding a paper-like sheet, comprising:

a housing having an inlet opening for receiving a paper-like sheet and an outlet opening for permitting egress of a fully folded paper-like sheet;

an input drive arrangement in the housing which advances a paper-like sheet from said inlet opening into said housing;

a guide in the housing which guides said advancing sheet into a loop that turns back upon itself such that a leading edge of said sheet impinges upon a transverse line in a trailing portion of said sheet;

an output roller arrangement in the housing which forms a folding nip extending along and adjacent to said transverse line, such that as said leading edge continually advances against said transverse line in said trailing portion of said sheet, said leading edge and said transverse line are forced into said folding nip in order to form a first creased fold in said sheet extending along said transverse line and containing said sheet leading edge and upon further operation, a remaining portion of said sheet extending in a loop passes through said folding nip to form a second creased fold, thereby folding said sheet into a fully folded paper-like sheet having three sections and supplying said fully folded paper-like sheet to said outlet opening in said housing; and a stocker mounted on an outside wall of said housing adjacent to said outlet opening for stocking a plurality of said fully folded paper-like sheets.

12. A paper folder according to claim 11, wherein said stocker includes:

a bent rod having:

a first section that extends into said housing; and a downwardly angled section connected with said first section and which is spaced slightly from said housing; and a spring within said housing for biasing said first section such that said downwardly angled section is pivoted towards said housing and said fully folded sheets are held by said downwardly angled section with a spring force.

13. A paper folder for folding a paper-like sheet, comprising:

a housing having an inlet opening for receiving a paper-like sheet and an outlet opening for permitting egress of a fully folded paper-like sheet;

an input paper tray for providing a stack of said paper-like sheets such that lower edges thereof are positioned adjacent said inlet opening;

an input drive arrangement in the housing which advances a paper-like sheet from said inlet opening into said housing, said input drive arrangement including:

an input drive roller having a circumferential gap, and an idler roller forming an input nip with said input drive roller;

a flexible stripper pad of high friction material positioned at said circumferential gap;

a guide in the housing which guides said advancing sheet into a loop that turns back upon itself such that a leading edge of said sheet impinges upon a transverse line in a trailing portion of said sheet;

an output roller arrangement in the housing which forms a folding nip extending along and adjacent to said transverse line, such that as said leading edge continually advances against said transverse line in said trailing portion of said sheet, said leading edge and said transverse line are forced into said folding nip in order to form a first creased fold in said sheet extending along said transverse line and containing said sheet leading edge and upon further operation, a remaining portion of said sheet extending in a loop passes through said folding nip to form a second creased fold, thereby folding said sheet into a fully folded paper-like sheet having three sections and supplying said fully folded paper-like sheet to said outlet opening in said housing.

14. A paper folder according to claim 13, wherein said input drive roller arrangement includes a single input drive roller having a circumferential groove which forms said circumferential gap.

15. A paper folder according to claim 13, wherein said input drive roller arrangement includes two coaxial, spaced apart drive rollers having the circumferential gap therebetween.

16. A paper folder according to claim 13, further comprising a fixed beam positioned in front of a lower portion of the paper tray, with said flexible stripper pad being secured to said fixed beam at a position of said circumferential gap.

17. A paper folder according to claim 13, further comprising an adjusting screw which extends through said fixed beam to adjust a position of said stripper pad relative to said input drive arrangement in order to adjust a gap between said input drive arrangement and said stripper pad.

18. A paper folder according to claim 13, further comprising a spring gate secured to said fixed beam between said stripper pad and said fixed beam.

19. A paper folder for folding a paper-like sheet, comprising:

a housing having an inlet opening for receiving a paper-like sheet and an outlet opening for permitting egress of a fully folded paper-like sheet;

an input paper tray for providing a stack of said paper-like sheets such that lower edges thereof are positioned adjacent said inlet opening;

an input drive arrangement in the housing which advances a paper-like sheet from said inlet opening into said housing, said input drive arrangement including:

an input drive roller arrangement having a circumferential gap, and an idler roller forming an input nip with said input drive roller arrangement;

a flexible stripper pad of high friction material positioned at said circumferential gap;

a fixed guide in the housing which guides said advancing sheet into a loop turning back upon itself such that a leading edge of said sheet impinges upon a transverse line in a trailing portion of said sheet;

an output roller arrangement in the housing which forms a folding nip extending along and adjacent to said transverse line;

a second drive arrangement in the housing in front of said transverse line for positively driving the leading edge of said sheet to impinge upon said transverse line, such that the second drive arrangement continually advances said leading edge against said transverse line in said trailing portion of said sheet to force both said leading edge of said sheet and said transverse line in said sheet into said folding nip in order to form a first creased fold in said sheet extending along said transverse line and containing said sheet leading edge, said second drive arrangement being separate and apart from said fixed guide;

whereby, upon further operation, said leading edge of said sheet remains within and travels with said fold as said fold passes through said folding nip, and a remaining portion of said sheet extending in a loop thereafter passes through said folding nip to form a second creased fold, thereby folding said sheet into a fully folded paper-like sheet having three sections and supplying said fully folded paper-like sheet to said outlet opening in said housing; and a stocker mounted on an outside wall of said housing adjacent to said outlet opening for stocking a plurality of said fully folded paper-like sheets.

* * * * *